US005253839A

United States Patent [19]

McClure

[11] Patent Number: 5,253,839

[45] Date of Patent: Oct. 19, 1993

[54] BRACE

[76] Inventor: Alex R. McClure, 4 Lugo Court, Tullamarine, Victoria, Australia

[21] Appl. No.: 793,411

[22] PCT Filed: Jul. 19, 1990

[86] PCT No.: PCT/AU90/00308

§ 371 Date: Jan. 13, 1992

§ 102(e) Date: Jan. 13, 1992

[87] PCT Pub. No.: WO91/01424

PCT Pub. Date: Feb. 7, 1991

[30] Foreign Application Priority Data

Jul. 20, 1989 [AU] Australia ..... PJ 5370

[51] Int. Cl.[5] ..... A47F 5/00

[52] U.S. Cl. ..... 248/354.1; 52/127.2

[58] Field of Search ..... 248/354.1, 354.3, 351; 49/504; 52/127.2, 127.3, 127.4

[56] References Cited

U.S. PATENT DOCUMENTS

| | | | |
|---|---|---|---|
| 2,914,813 | 12/1959 | Christian | 52/127.2 |
| 3,001,244 | 9/1961 | Kronquist | 52/127.2 |
| 3,027,686 | 4/1962 | Oates | 52/127.2 |
| 3,168,305 | 2/1965 | Lee | 269/321 |
| 3,259,367 | 7/1966 | Squire | 254/101 |
| 3,403,486 | 10/1968 | Schubeis | 52/127 |
| 3,788,026 | 1/1974 | Cook | 52/127.2 |
| 3,851,868 | 12/1974 | Lagasse | 269/8 |
| 4,304,078 | 12/1981 | Meriwether | 248/354.1 |
| 4,707,925 | 11/1987 | Englehart | 33/194 |
| 4,829,727 | 5/1989 | Kuzara | 248/351 |
| 5,167,073 | 12/1992 | Stein | 52/127.2 |

FOREIGN PATENT DOCUMENTS

| | | | |
|---|---|---|---|
| 153581 | 4/1951 | Australia . | |
| 529046 | 5/1983 | Australia . | |
| 816455 | 7/1949 | Fed. Rep. of Germany | 52/127.2 |
| 1907715 | 8/1970 | Fed. Rep. of Germany . | |
| 1247857 | 10/1960 | France . | |
| 1486841 | 5/1967 | France . | |
| 2044452 | 2/1971 | France . | |
| 159565 | 6/1971 | New Zealand . | |
| 179957 | 6/1979 | New Zealand . | |
| 129218 | 12/1928 | Switzerland . | |
| 175936 | 6/1935 | Switzerland . | |
| 466550 | 1/1969 | Switzerland . | |
| 579186 | 8/1976 | Switzerland . | |
| 597438 | 4/1978 | Switzerland . | |

*Primary Examiner*—J. Franklin Foss

*Attorney, Agent, or Firm*—Merchant, Gould, Smith, Edell, Welter & Schmidt

[57] ABSTRACT

A device to brace a door frame (3), to prevent the sides of the door frame buckling when grout or other filler material is used to fill a gap between the door frame and an adjacent wall comprises, a pair of elongate support member (17), for contacting the sides of the door frame (3), upper and lower means (25, 27) coupling the support members together for movement between a retracted position and an expanded position, and means for selectively locking the support members (17) is the expanded position with the support members contacting and bracing the sides of the door frame (3).

16 Claims, 2 Drawing Sheets

BRACE

The present invention relates to a device to brace a door frame.

Usually, door frames for fire doors and standard doors in block walls (as opposed to partition walls) in multi-storey buildings comprise elongate channels pressed from sheet metal, and the hollow regions defined by the channels must be filled with grout or other filler material in order to comply with building regulations. In addition, usually, there is a gap of up to 50 mm between the door frames and the adjacent walls which must also be filled with grout. In the case of fire-doors the grout must be a fire resistant grout.

It is important that the door frames do not buckle or otherwise deform when the hollow regions and the gaps are filled with grout. This is particularly important in the case of fire doors since building regulations prescribe close tolerances between the door frames and the fire doors, and as a consequence the fire floors will not fit the openings properly if the door frames are even slightly out of square.

In order to minimise buckling or other deformation, it is standard practice to brace the door frames while the grout is being poured into the hollow regions and the gaps and during the time it takes for the grout to substantially set. Typically, the door frames are braced either with lengths of timber which are wedged into position or with so-called "acrow" props.

There are a number of drawbacks associated with the use of such conventional means to brace the door frames. One drawback is that the bracing members prevent access through the doorways, and this can be particularly inconvenient since the grout usually requires at least several hours to set sufficiently to allow the bracing members to be removed. Another drawback is that the bracing members, particularly timber, tend to scratch or otherwise damage the door frames. Moreover, the timber generally is not re-used and this tends to increase the cost of the work. In addition, the bracing members often cause an outward pressure on the door frames which itself causes distortion of the door frames.

An object of the present invention is to provide a device to brace a door frame which alleviates the drawbacks described in the preceding paragraph.

According to the present invention there is provided a device to brace a door frame formed from elongate channel members to prevent the sides of the door frame buckling or otherwise deforming when grout or other filler material is used to fill a hollow region defined by the channel members and/or a gap between the door frame and an adjacent wall, comprising:

(a) a pair of elongate support members each having a surface adapted to contact a side of the door frame substantially along the length thereof;

(b) a means coupling the support members together for movement between a retracted position and an expanded position: and (c) a means for selectively locking the support members in the expanded position with the contact surfaces in contact with the opposed sides of the door frame to brace the sides of the door frame.

It is preferred that the coupling means comprises an upper and a lower arm extending from each support member, one upper arm arranged to telescope in the other upper arm and one lower arm arranged to telescope in the other lower arm.

It is preferred that the lower arms define a base to contact the floor.

It is preferred that the device further comprises an adjustable member to vary the side-to-side inclination of the base with respect to the floor.

It is preferred particularly that the device comprises one of said adjustable members at each end of the base.

It is preferred that the device further comprises a leg pivotally connected to each support member for swinging movement outwardly away from the support member, each leg being adjustable in length, whereby, in use, the legs can be manipulated to locate the support members at a required front-to-rear inclination with respect to the floor.

It is preferred particularly that each leg has a tiltable base plate at the free end to firmly contact the floor irrespective of the angle of the leg with respect to the floor.

It is preferred particularly that each leg is telescopic and comprises, a first element, and a second element positioned to slide in the first element, and a means to lock the first and second elements together at a required position.

It is preferred that the device further comprises, a telescopic reinforcing member pivotally connected at one end to one support member for swinging movement from an inoperative position at which the reinforcing member rests against the one support member and does not obstruct the door opening to a reinforcing position at which the reinforcing member extends across the door opening and contacts the other support member thereby to reinforce the device.

It is preferred that the reinforcing member is pivotally connected at a point approximately half way along the length of the support member.

It is preferred that the device further comprises a sleeve extending inwardly from the other support member arranged to receive the free end of the reinforcing member when the reinforcing member is pivoted and telescoped to the reinforcing position.

It is preferred that two devices as described above are coupled together so there are two spaced apart parallel contact surfaces to contact each side of the door frame. Such an arrangement is particularly adapted to support a door frame which has two rebates separated by a central jamb, with one device positioned to contact one rebate and the other device positioned to contact the other rebate.

The present invention is described further with reference to the accompanying drawings, in which.

The two preferred embodiments shown in the figures are coupled together to form an assembly to brace a door frame 3 to prevent the sides of the door frame 3 buckling or otherwise deforming when grout or other filler material is used to fill the gap between the door frame 3 and an adjacent wall.

Figure 3:
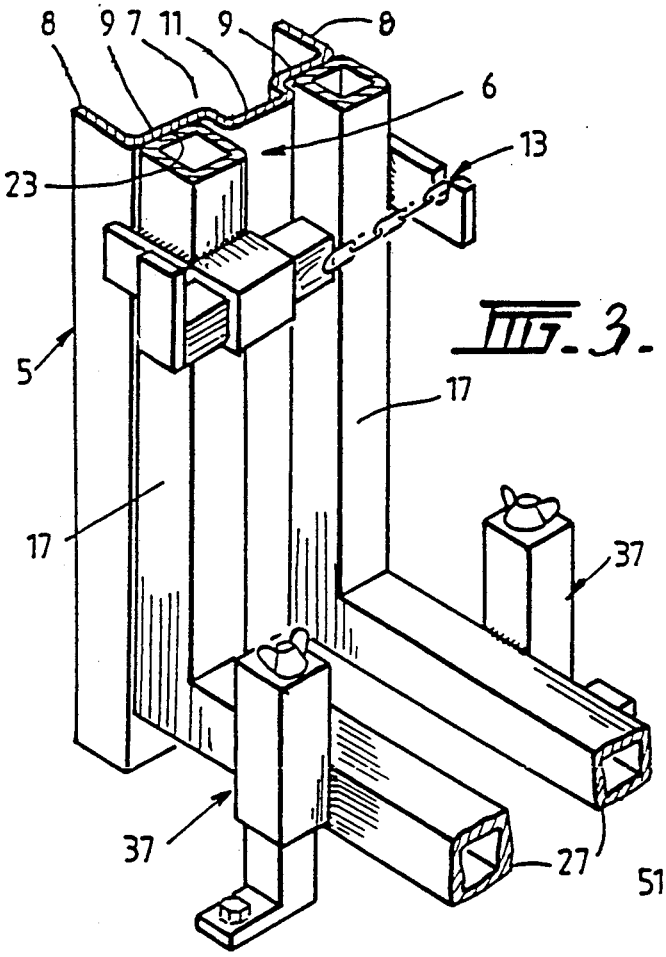
FIG. 3 is a perspective view in the direction of the arrow 3 in FIG. 1.

As can best be seen in FIG. 3, the door frame 3 is formed from an elongate channel member 5 which defines a hollow space 7. The channel member 5 comprises a web 6 interconnecting two flanges 8. The web 6 comprises two rebates 9 and an intermediate raised section 11 which forms the door jamb. In use, the door frame 3 is positioned in an opening in a dividing wall or stairwell of a multi-storey building. Typically, there is a gap of 50 mm between the wall and the door frame 3, and it is necessary to fill the gap 4 and the hollow space 7 defined by the channel member 5 with grout or other suitable filler material.

Figure 2:
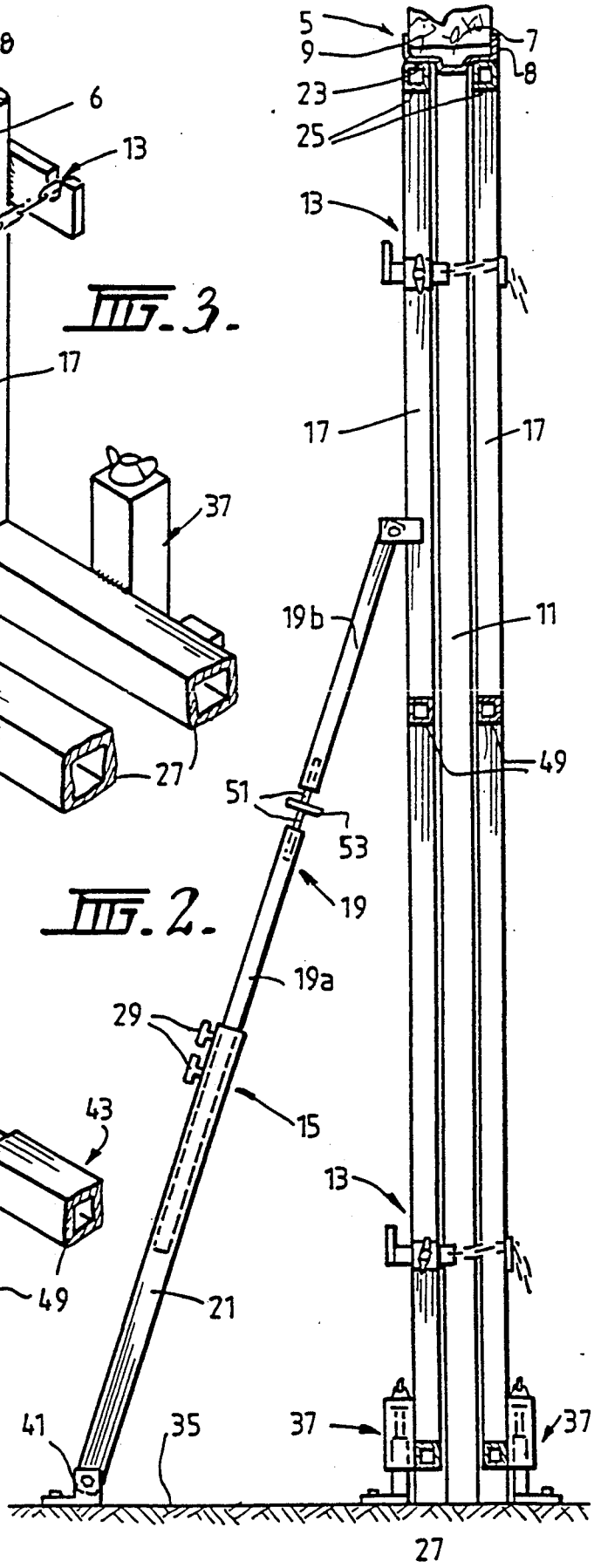
FIG. 2 is a section along the line 2—2 in FIG. 1.
Figure 4:
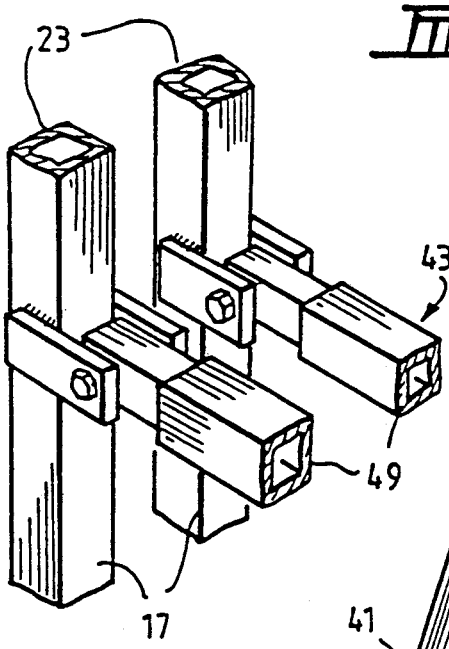
FIG. 4 is a perspective view in the direction of the arrow 4 in FIG. 1.

As can best be seen in FIG. 2, the two preferred embodiments shown in the figures are coupled together by means of a detachable chain arrangement, generally identified by the numeral 13. It can readily be appreciated that the chain arrangement 13 is adjustable so that the spacing can conveniently be varied to adapt the preferred embodiments for use with door frames 3 having different dimensions for the rebates 9 and the raised section 11.

The two preferred embodiments shown in the figures are identical, with the exception that one includes swingable telescopic legs 15 which are described in more detail hereinafter.

Figure 1:
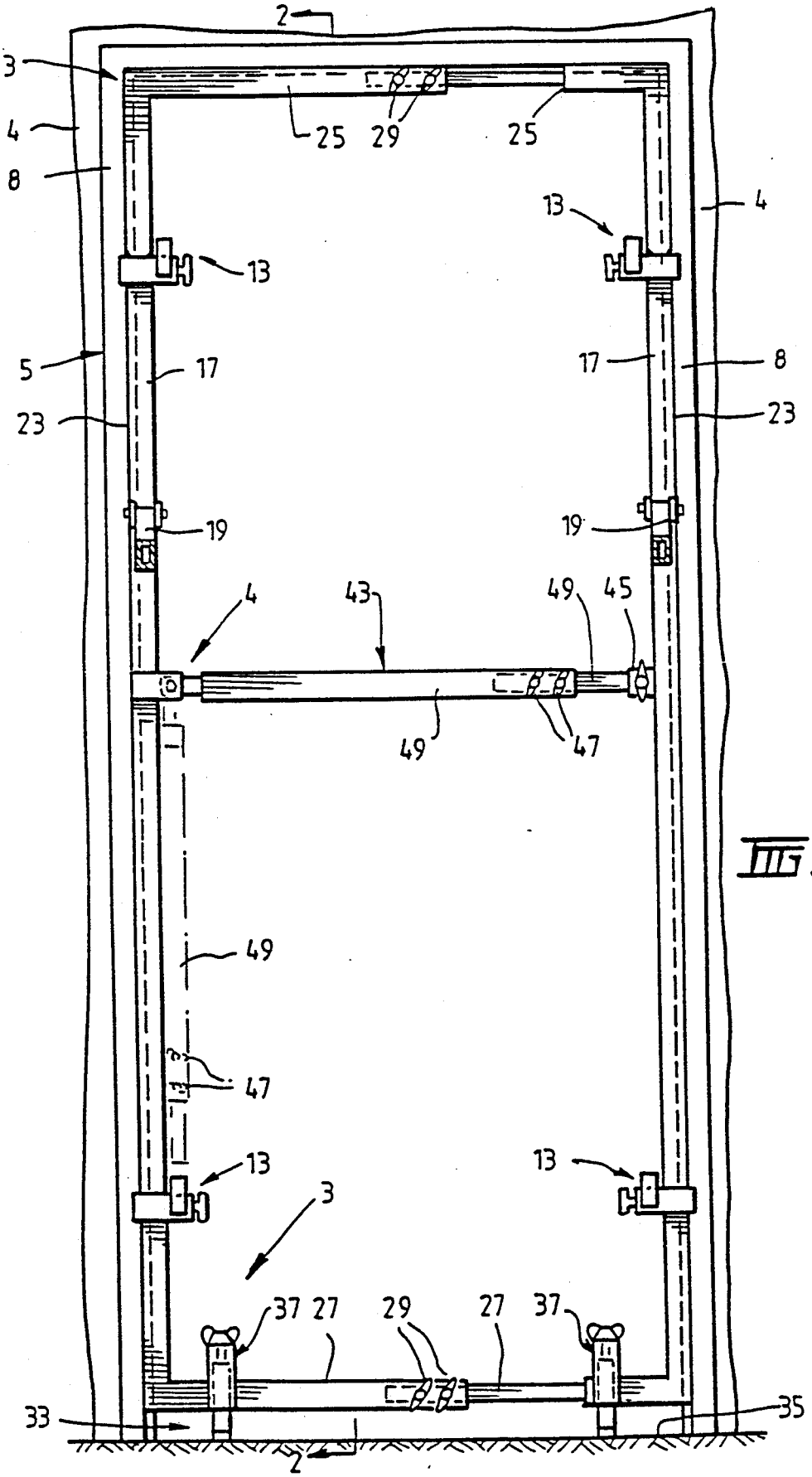
FIG. 1 is a front view of two preferred embodiments of a device of the invention coupled together to brace a door frame.

In the circumstances, in order to simplify the description, the following discussion relates only to the forward one of the two preferred embodiments, as viewed in FIG. 1, which includes the telescopic legs 15.

The preferred embodiment is formed from tubular steel and comprises the following main components:

(a) a pair of elongate support members 17 each having a surface 23 adapted to contact a side of the door frame 3 substantially along the length thereof;

(b) an upper arm 25 and a lower arm 27 extending from each support member 17, with one upper arm 25 arranged to telescope in the other upper arm 25 and one lower arm 27 arranged to telescope in the other lower arm 27 so that by selective telescoping movement the support members 17 can be moved from a retracted position to an expanded position at which the contact surfaces 23 of the support members 17 contact opposite sides of the door frame 3; and (c) locking means in the form of threaded T-bolts 29 extending through nuts (not shown) to lock the upper arms 25 and the lower arms 27 together when the support members 17 are in the expanded position thereby to brace the sides of the door frame 3.

It will be noted from FIG. 1 that the upper arms 25 define a contact surface for the top of the door frame 3 and the lower arms 27 define a base, generally identified by the numeral 33.

The preferred embodiment further comprises an adjustable member 37 at each end of the base 33 which contacts the floor 35 and can be selectively manipulated to vary the side-to-side level of the preferred embodiment with respect to the floor 35.

As is indicated briefly above, the preferred embodiment further comprises a pair of swingable adjustable legs 15 adapted to extend laterally to the plane of the door frame 3 to adjust the front-to-rear inclination of the preferred embodiment with respect to the floor 35. As can best be seen in FIG. 2, each leg 15 is in two main parts, with one part 19 arranged to telescope within the other part 21, thereby to vary the length of the leg 15, and has locking members 29 to lock the two parts at a required length. The locking members 19 are suitable for making a coarse adjustment of the length of the legs 15. Each leg 15 further comprises means to finely adjust the length of the leg 15. In this regard, the part 19 is formed as two sections 19*a*, 19*b* which are connected together by a member which has threaded elements 51 which extend into threaded openings in the sections 19*a*, 19*b* and a central adjustment element 53 which can be gripped and rotated by an operator to vary the spacing of the sections 19*a*, 19*b*. Each leg 15 is pivotally connected at one end to a respective one of the support members 17 for swinging movement away from the preferred embodiment. In the assembly shown in the figures, the legs 15 are connected approximately midway along the length of the support members 17, although it can readily be appreciated that the legs 15 could be located at any suitable point along the length of the support members 17. The free end of each leg 15 carries a tiltable base plate 41 which is adapted to firmly and evenly contact the floor 35 irrespective of the inclination of the leg 15 with respect to the floor 35. In addition, the tiltable base plate 41 has openings (not shown) to receive bolts to firmly lock the legs 15 and thereby the preferred embodiment in a required position.

It can readily be appreciated that in use the legs 15 can be manipulated to selectively locate the support members 17 at a required front-to-rear inclination with respect to the floor 35.

The preferred embodiment further comprises a reinforcing member 43 to ensure that the support members 17 do not buckle or otherwise deform. The reinforcing member 43 is pivotally connected at one end to one of the support members 17 and, as can best be seen in FIG. 1, can be swung from an inoperative position at which the reinforcing member 43 rests against one of the support members 17 to an operative position at which the reinforcing member 17 extends across the door opening and the free end of the reinforcing member 43 is received in a sleeve 45 on the other support member 17. In this regard, the reinforcing member 43 is formed from two parts 49 which are arranged to telescope together so that the free end can conveniently be slid into the sleeve 45. In addition, it will be noted from FIG. 1 that locking means 47 are provided to lock the free end in the sleeve 45 and to lock the two parts 49 together.

It is intended that the reinforcing member 43 is used only during the initial stages when the grout is poured to fill the gap and that within a short period of time thereafter the reinforcing member 45 is swung to the inoperative position to allow access through the door opening.

It can readily be appreciated that the preferred embodiment with the telescopic adjustable legs 15 described above, either separately or in combination with the other preferred embodiment, is particularly adapted for use to support a free-standing door frame 3 in such a way that access though the door frame 3 is not restricted. Moreover, it can readily be appreciated that by bolting the legs 15 to the floor it is possible to position the preferred embodiments securely to the floor and by manipulating the adjustable members 37 and the legs 15 it is possible to position and support the door frame 3 in a required orientation with respect to the floor.

Many modifications may be made to the preferred embodiments described above without departing from the spirit and scope of the present invention.

In this regard, whilst the preferred embodiment is described in relation to a double rebate door frame it can readily be appreciated the present invention is not restricted to this application and, for example, can be used in relation to single rebate door frames.

I claim:

1. A device to brace a door frame the prevent the sides of the door frame buckling or otherwise deforming when grout or other filler material is used to fill a hollow region defined by channel members constituting the door frame and/or gap between the door frame and an adjacent wall, comprising:

(a) a pair of elongate support members each having a contact surface which can contact a side of the door frame substantially along the length thereof;

(b) at least one coupling means coupling the support members together so that the support members are movable between a retracted position and an expanded position;

(c) a fastener means for selectively locking the support members in the expanded position with the contact surfaces contacting the opposed sides of the door frame to brace the sides of the door frame; and (d) a leg member pivotally connected to each support member for swinging movement laterally to the plane of the door frame, each leg member being adjustable in length to locate the support members at a required inclination with respect to the floor.

2. The device defined in claim 1, wherein each leg member has a tiltable base plate at the free end to firmly contact the floor irrespective of the angle of the leg member with respect to the floor.

3. The device defined in claim 2, wherein each leg member is telescopic and comprises, a first element, and a second element positioned to slide in the first element, and a securement means to lock the first and second elements together at a required position.

4. The device defined in claim 2, wherein the coupling means comprises an upper and a lower arm extending from each support member, one upper arm arranged to telescope in the other upper arm and one lower arm arranged to telescope in the other lower arm.

5. The device defined in claim 4 further comprising, a telescopic reinforcing member pivotally connected at one end to one support member for swinging movement from an inoperative position at which the reinforcing member rests against the one support member and does not obstruct the door frame opening to a reinforcing position at which the reinforcing member extends across the door frame opening and contacts the other support member thereby to reinforce the device.

6. The device defined in claim 1, wherein each leg member is telescopic and comprises, a first element, and a second element positioned to slide in the first element, and a securement means to lock the first and second elements together at a required position.

7. The device defined in claim 6, wherein the coupling means comprises an upper and a lower arm extending from each support member, one upper arm arranged to telescope in the other upper arm and one lower arm arranged to telescope in the other lower arm.

8. The device defined in claim 7, wherein the lower arms define a base to contact the floor.

9. The device defined in claim 8, further comprising an adjustable member to vary the side-to-side inclination of the base with respect to the floor.

10. The device defined in claim 9, wherein one of said adjustable members is at each end of the base.

11. The device defined in claim 10 further comprising, a telescopic reinforcing member pivotally connected at one end to one support member for swinging movement from an inoperative position at which the reinforcing members rests against the one support member and does not obstruct the door frame opening to a reinforcing position at which the reinforcing member extends across the door frame opening and contacts the other support member thereby to reinforce the device.

12. The device defined in the 11, wherein the reinforcing member is pivotally connected at a position approximately half way along the length of the one support member.

13. The device defined in claim 11 further comprises a sleeve extending inwardly from the other support member arranged to receive the free end of the reinforcing member when the reinforcing member is pivoted and telescoped to the reinforcing position.

14. The device defined in claim 1, wherein the coupling means comprises an upper and a lower arm extending from each support member, one upper arm arranged to telescope in the other upper arm and one lower arm arranged to telescope in the other lower arm.

15. The device defined in claim 12 further comprising, a telescopic reinforcing member pivotally connected at one end to one support member for swinging movement from an inoperative position at which the reinforcing member rests against the one support member and does not obstruct the door frame opening to a reinforcing position at which the reinforcing member extends across the door frame opening and contacts the other support member thereby to reinforce the device.

16. The device defined in claim 1 further comprising, a telescopic reinforcing member pivotally connected at one end to one support member for swinging movement from an inoperative position at which the reinforcing member rests against the one support member and does not obstruct the door frame opening to a reinforcing position at which the reinforcing member extends across the door frame opening and contacts the other support member thereby to reinforce the device.

* * * * *